US007272931B2

(12) United States Patent
Held et al.

(10) Patent No.: US 7,272,931 B2
(45) Date of Patent: Sep. 25, 2007

(54) METHOD AND APPARATUS TO DECREASE COMBUSTOR ACOUSTICS

(75) Inventors: Timothy James Held, Blanchester, OH (US); George Chiachun Hsiao, West Chester, OH (US)

(73) Assignee: General Electric Company, Schenectady, NY (US)

( * ) Notice: Subject to any disclaimer, the term of this patent is extended or adjusted under 35 U.S.C. 154(b) by 787 days.

(21) Appl. No.: 10/663,008

(22) Filed: Sep. 16, 2003

(65) Prior Publication Data

US 2005/0056022 A1 Mar. 17, 2005

(51) Int. Cl.
*F02C 1/00* (2006.01)
*F02C 7/24* (2006.01)
*F23M 13/00* (2006.01)

(52) U.S. Cl. ..... 60/772; 60/725; 431/114

(58) Field of Classification Search ..... 60/725, 60/737, 772; 431/114
See application file for complete search history.

(56) References Cited

U.S. PATENT DOCUMENTS

| | | | | |
|---|---|---|---|---|
| 5,373,695 | A | 12/1994 | Aigner et al. | |
| 5,685,157 | A | 11/1997 | Pandalai et al. | |
| 6,205,765 | B1 * | 3/2001 | Iasillo et al. | 60/773 |
| 2002/0100281 | A1 | 8/2002 | Hellat et al. | |

FOREIGN PATENT DOCUMENTS

| | | |
|---|---|---|
| GB | 2288660 A | 10/1995 |
| WO | WO93/10401 | 11/1991 |

* cited by examiner

*Primary Examiner*—Charles G Freay
(74) *Attorney, Agent, or Firm*—William Scott Andes; Armstrong Teasdale LLP

(57) ABSTRACT

A method for operating a gas turbine engine includes coupling an anti-resonant frequency system to a combustor including a premixer assembly and a plurality of damper tubes, and adjusting the anti-resonant frequency system until the anti-resonant frequency of the damper tubes is approximately equal to the combustor resonant frequency.

20 Claims, 4 Drawing Sheets

METHOD AND APPARATUS TO DECREASE COMBUSTOR ACOUSTICS

BACKGROUND OF THE INVENTION

This application relates generally to gas turbine engines and, more particularly, to gas turbine combustors.

Air pollution concerns worldwide have led to stricter emissions standards both domestically and internationally. Pollutant emissions from industrial gas turbines are subject to Environmental Protection Agency (EPA) standards that regulate the emission of oxides of nitrogen (NOx), unburned hydrocarbons (HC), and carbon monoxide (CO). In general, engine emissions fall into two classes: those formed because of high flame temperatures (NOx), and those formed because of low flame temperatures which do not allow completion of the fuel-air reaction (HC & CO).

At least some known gas turbine combustors include a plurality of mixers, which mix high velocity air with liquid or gaseous fuels prior to the mixture being ignited. Such mixers usually include a single fuel injector located at a center of a swirler which swirls incoming air to facilitate enhancing flame stabilization and mixing. Both the fuel injector and mixer are coupled to a combustor dome.

At least some known gas turbine engine combustors operate with a fuel to air ratio in the mixer that is fuel-rich, wherein additional air is added through discrete dilution holes prior to the combustion gases exiting the combustor. However, poor mixing and hot spots may occur both at the dome, where the injected fuel must vaporize and mix prior to burning, and in the vicinity of the dilution holes, wherein additional air is added to the rich dome mixture. Other known gas turbine engines use dry-low-emissions (DLE) combustors that create fuel-lean mixtures in the mixer. Because the fuel-air mixture throughout the combustor is lean, DLE combustors typically do not have dilution holes.

In operation, combustion acoustics may limit the operational range of lean premixed gas turbine combustors. To facilitate reducing combustion acoustics, at least some known gas turbine engines utilize mismatched flame temperatures. However, mismatching the flame temperatures may result in increasing NOx emissions. Other known gas turbine engines use a variety of passive means to facilitate reducing the amplitude of the combustion acoustics. For example, at least one known gas turbine engine uses a plurality of quarter-wave acoustic damper tubes to reduce combustor acoustics. Quarter-wave damper tubes operate over a relatively narrow band of frequencies, and are fabricated in a plurality of lengths. To determine the optimum length of a damper tube, a time consuming process may be required. The process includes coupling a damper tube having a predetermined length to the gas turbine, and measuring the resultant combustor acoustics. The process must generally be repeated until the optimal damper tube length has been identified.

BRIEF SUMMARY OF THE INVENTION

In one aspect, a method for operating a gas turbine engine is provided. The method includes coupling an anti-resonant frequency system to a combustor including a premixer assembly and a plurality of damper tubes, and adjusting the anti-resonant frequency system until the anti-resonant frequency of the damper tubes is approximately equal to a resonant frequency of the combustor.

In another aspect, a combustor system for a gas turbine engine is provided. The combustor system includes a premixer assembly, a plurality of damper tubes, and an anti-resonant frequency system coupled to the plurality of damper tubes. The anti-resonant frequency system is configured to adjust the anti-resonant frequency of the damper tubes until the anti-resonant frequency of the damper tubes is approximately equal to a resonant frequency of the combustor.

In a further aspect, a gas turbine engine including a compressor, a turbine coupled in flow communication with the compressor, and a combustor system between the compressor and the turbine is provided. The combustor system includes a premixer assembly, a plurality of damper tubes, and an anti-resonant frequency system coupled to the plurality of damper tubes. The anti-resonant frequency system is configured to adjust the anti-resonant frequency of the damper tubes until the anti-resonant frequency of the damper tubes is approximately equal to a resonant frequency of the combustor.

DETAILED DESCRIPTION OF THE INVENTION

Figure 1:
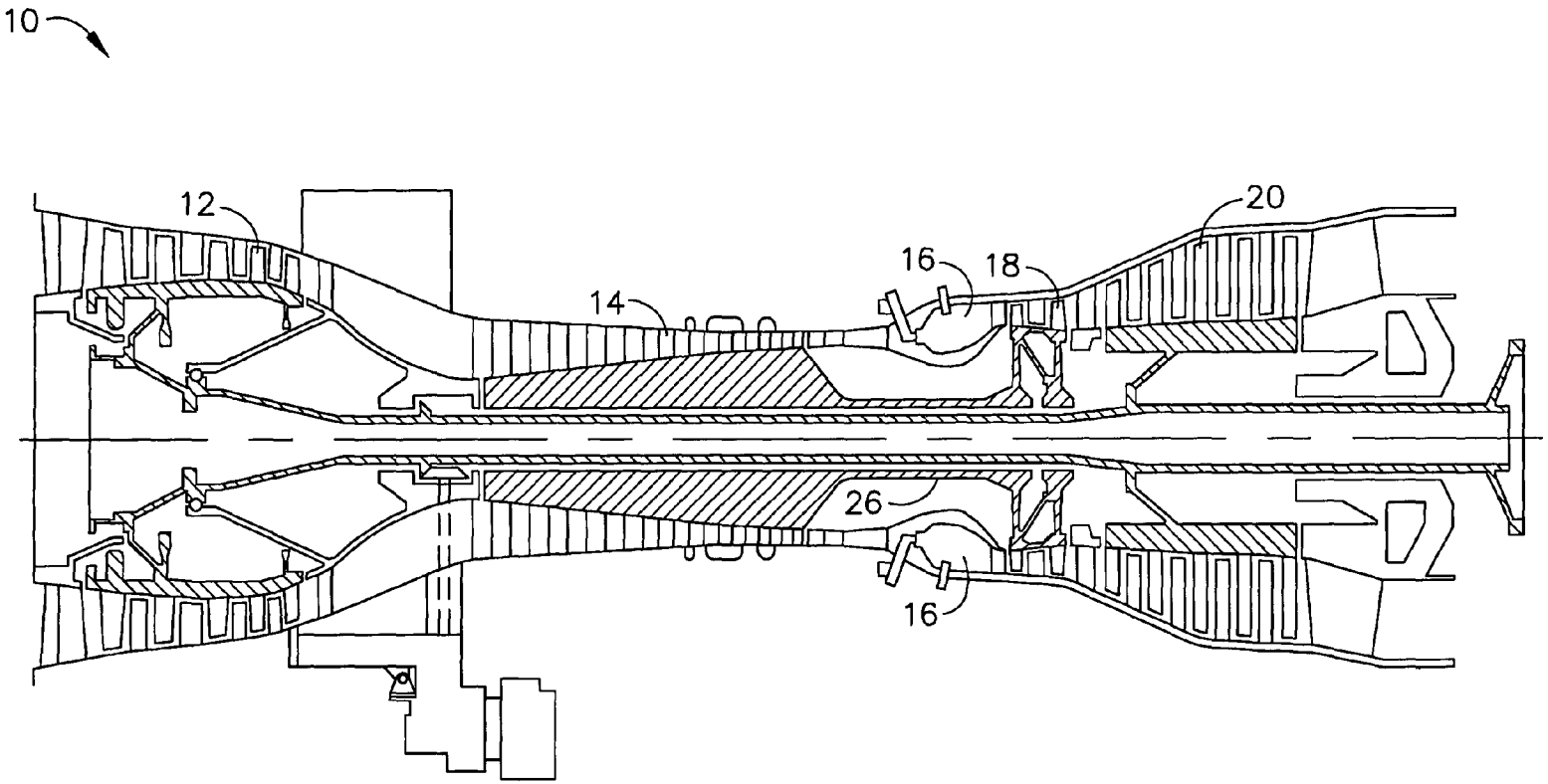
FIG. 1 is schematic illustration of a gas turbine engine including a combustor.

FIG. 1 is a schematic illustration of a gas turbine engine 10 including a low pressure compressor 12, a high pressure compressor 14, and a combustor 16. Engine 10 also includes a high pressure turbine 18 and a low pressure turbine 20.

In operation, air flows through low pressure compressor 12 and compressed air is supplied from low pressure compressor 12 to high pressure compressor 14. The highly compressed air is delivered to combustor 16. Airflow (not shown in FIG. 1) from combustor 16 drives turbines 18 and 20. In one embodiment, gas turbine engine 10 is a LM2500 engine available from General Electric Company, Cincinnati, Ohio. In another embodiment, gas turbine engine 10 is a LM6000 engine available from General Electric Company, Cincinnati, Ohio. In a further embodiment, gas turbine engine 10 is a LM1600 engine available from General Electric Company, Cincinnati, Ohio.

Figure 2:
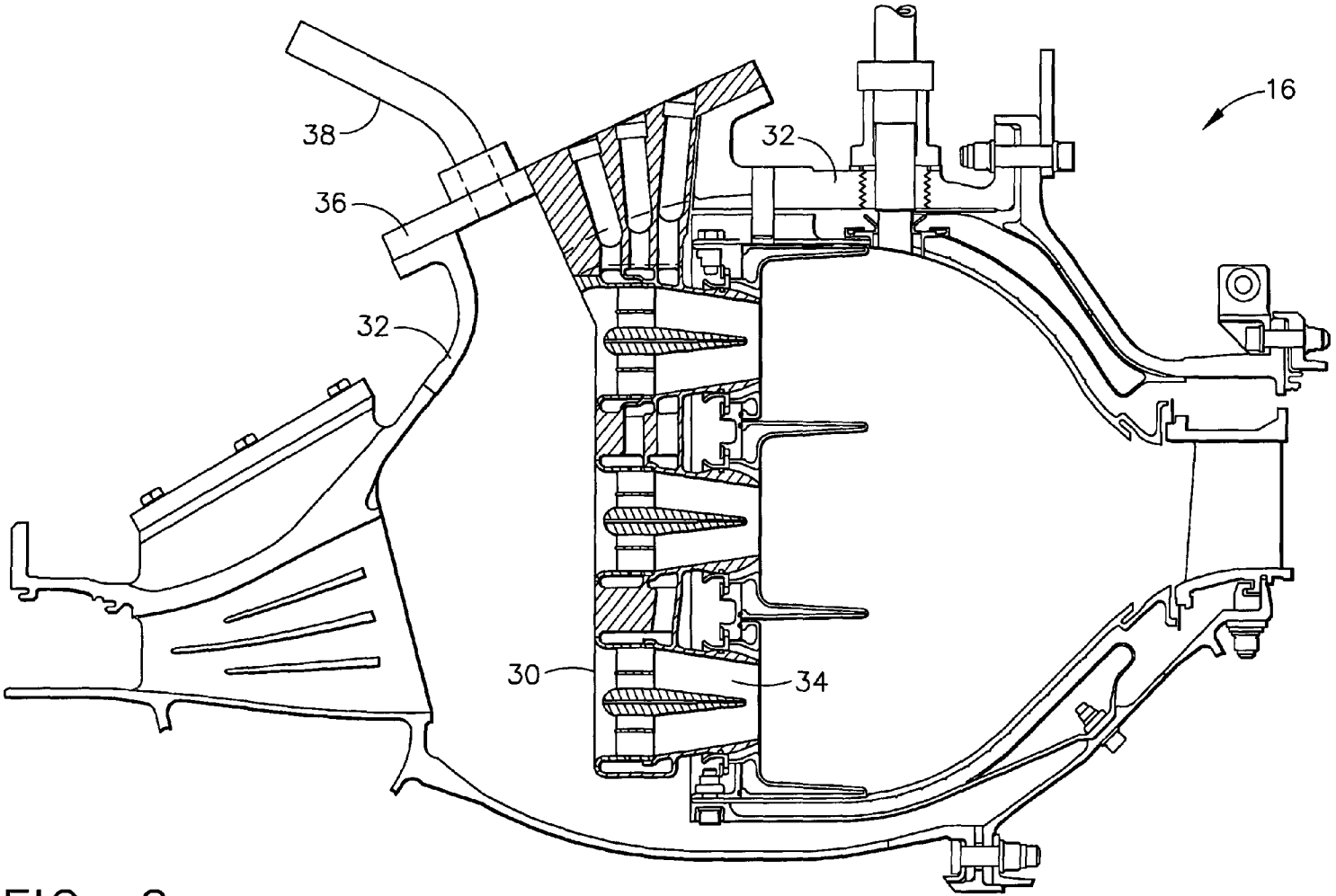
FIG. 2 is a cross-sectional view of a portion of a combustor that may be used with the gas turbine engine shown in FIG. 1.

FIG. 2 is a cross-sectional view of combustor 16 for use with a gas turbine engine, similar to engine 10 shown in FIG. 1. Combustor 16 includes a premixer assembly 30 coupled to a combustor outer casing 32. Premixer assembly 30 includes a plurality of premixing swirlers 34 mounted circumferentially around combustor 16, and an end flange 36. Combustor 16 also includes a plurality of acoustic dampers 38 coupled to end flange. As shown in FIG. 2, because damper tubes 38 are mounted on an external portion of engine 10, a damper tube temperature is typically less than a compressor discharge temperature (T3). In the exemplary embodiment, swirlers 34 are coupled in flow communication to a fuel source (not shown) and are thus configured to inject fuel therethrough, which facilitates improving fuel-air mixing of fuel injected from swirlers 34.

Figure 3:
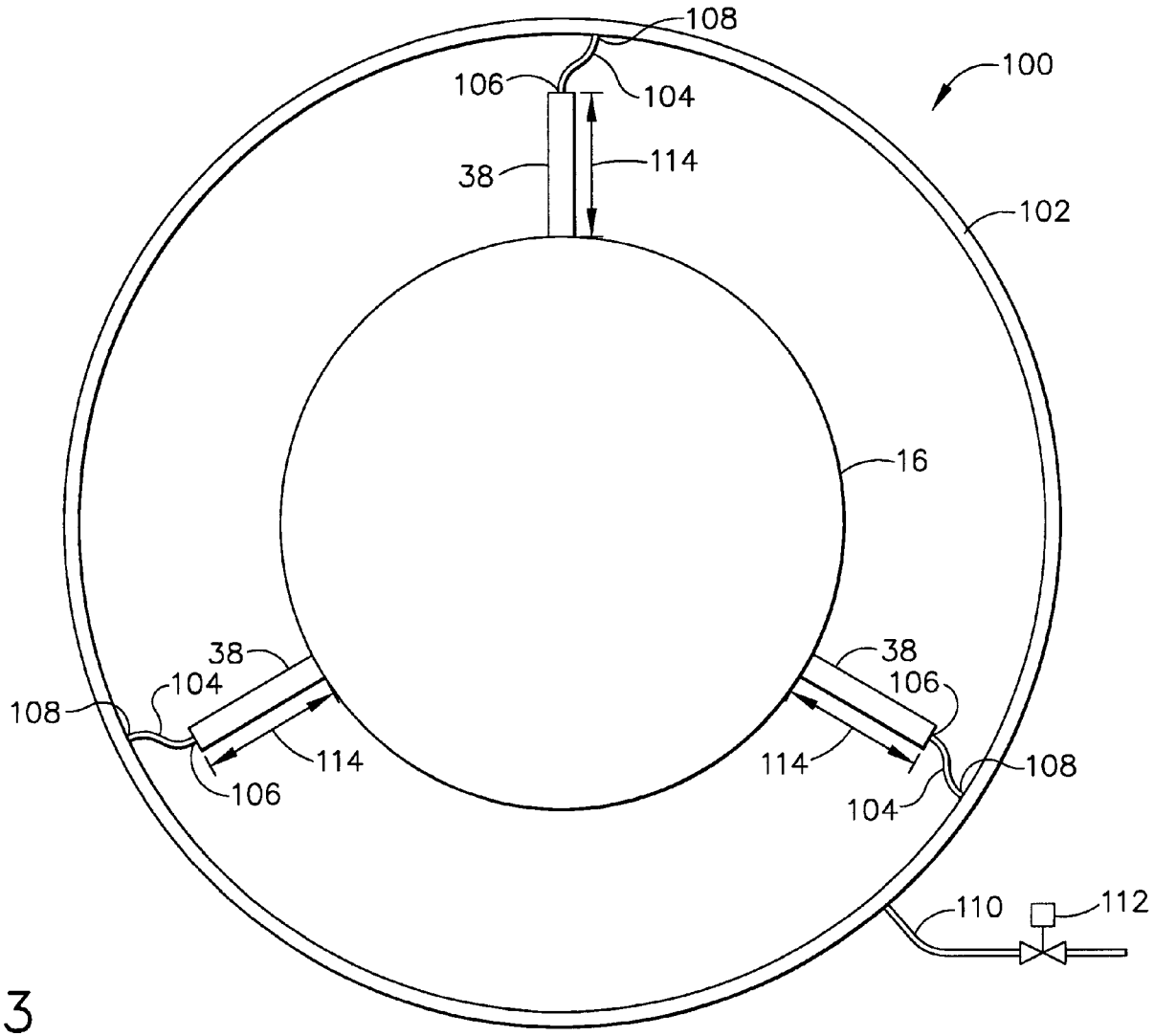
FIG. 3 is an end view of an exemplary combustor anti-resonant frequency system that can be used with the gas turbine engine shown in FIG. 1.

FIG. 3 is an end view of an exemplary combustor anti-resonant frequency system 100 that can be used with engine 10 (shown in FIG. 1). System 100 includes a substantially hollow bleed manifold 102 coupled to engine 10, and a plurality of substantially hollow extension tubes 104. In the exemplary embodiment, extension tubes 104 each include a first end 106 coupled to acoustic dampers 38 and a second end 108 coupled to manifold 102. System 100 also includes a bleed tube 110 coupled to bleed manifold 102, and an adjustable bleed valve 112 coupled to bleed tube 110.

Damper tubes 38 have a central frequency in which damper tubes 38 are effective. The central frequency of damper tubes 38 is based on a length 114 of damper tube 38 and an acoustic velocity of the air contained within damper tubes 38. Accordingly, damper tubes 38 are designed in accordance with:

$f=c/4*L$, where:

$c=\sqrt{\gamma RT}$ is the acoustic velocity of the air, f is an effective frequency of damper tube 38, L is an effective length of damper tube 38, $\gamma$ is a ratio of specific heats of the air, R is a gas constant of air, and T is an air temperature.

In operation, gas turbine engine 10 is started and a quantity of air is discharged from combustor 16 through damper tubes 38, extension tubes 104, and into manifold 102. Bleed valve 112 is then adjusted, i.e. opened or closed, to release air from manifold 102 to atmosphere such until the anti-resonant frequency of damper tubes 38 is approximately equivalent to the combustor resonant frequency.

Figure 4:
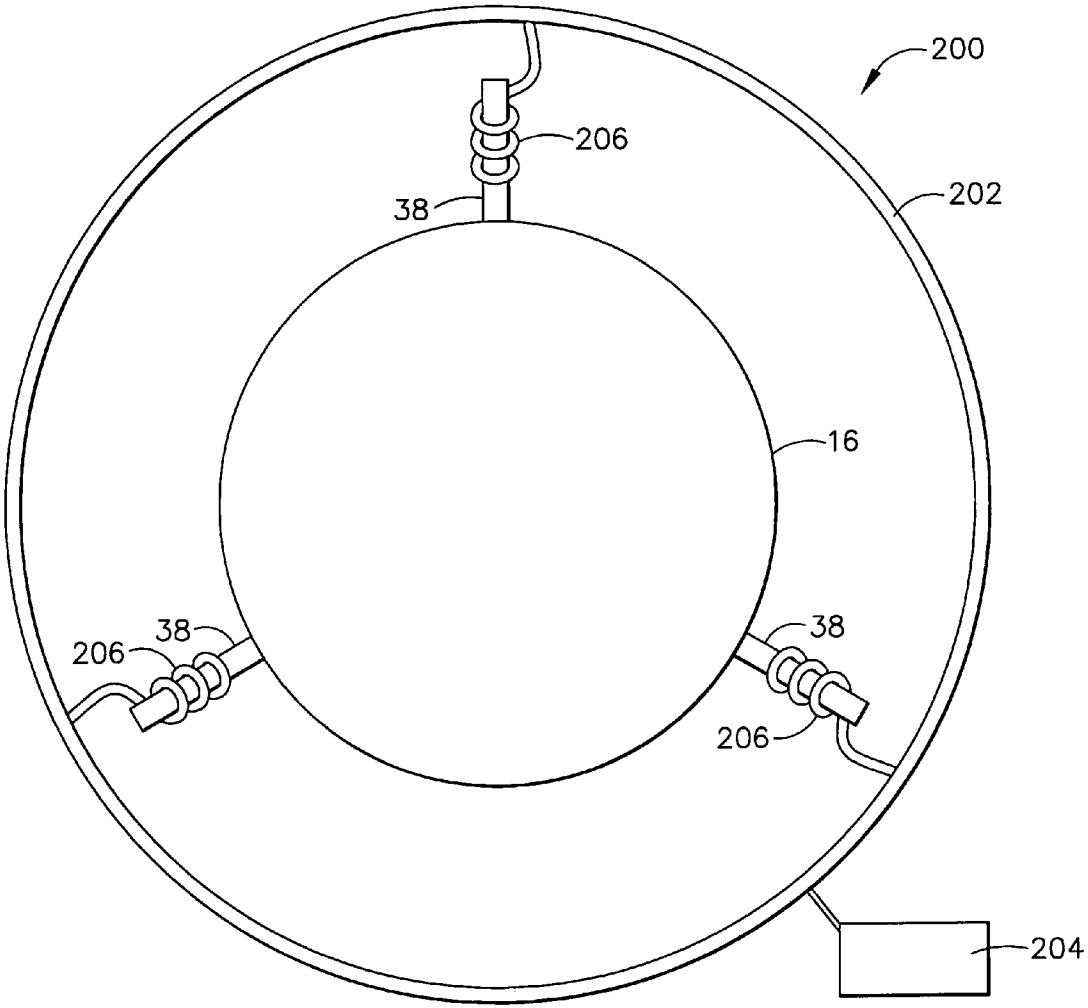
FIG. 4 is an end view of another exemplary combustor anti-resonant frequency system that can be used with the gas turbine engine shown in FIG. 1.

FIG. 4 is an end view of another exemplary combustor anti-resonant frequency system 200 that can be used with engine 10 (shown in FIG. 1). Anti-resonant frequency system 200 is substantially similar to anti-resonant frequency system 100, (shown in FIG. 3) and components anti-resonant frequency system 200 that are identical to components of anti-resonant frequency system 100 are identified in FIG. 4 using the same reference numerals used in FIG. 3. In the exemplary embodiment, system 200 includes an electrical cable 202 electrically coupled to a power source 204, and a plurality of electrical heating elements 206. In another exemplary embodiment, system 200 includes a plurality of electrical cables 202 electrically coupled to a power source 204, and a plurality of electrical heating elements 206 wherein each heating element 206 is electrically coupled to power source 204 through plurality of electrical cables 202.

In one embodiment, electrical heating elements 206 are wrapped around an outer surface of damper tubes 38 to facilitate adjusting an air temperature within damper tubes 38. In another embodiment, electrical heating elements 206 are positioned within damper tubes 38 to facilitate adjusting the air temperature within damper tubes 38

As described previously herein, damper tubes 38 have a central frequency in which damper tubes 38 are effective. The central frequency of damper tubes 38 is based on a length 114 of damper tube 38 and an acoustic velocity of air within damper tubes 38. Accordingly, damper tubes 38 are designed in accordance with:

$f=c/4*L$, where:

$c=\sqrt{\gamma RT}$ is the acoustic velocity of the air, f is the effective frequency of damper tube 38, L is the effective length of damper tube 38, $\gamma$ is the ratio of specific heats of the air, R is the gas constant of air, and T is the air temperature.

In operation, power supply 204 is energized and an electrical current is passed through electrical cable 202 to each heating element 206. Power supply 204 is then adjusted, i.e. power is increased or decreased, such until the anti-resonant frequency of damper tubes 38 is approximately equivalent to the combustor resonant frequency.

The systems described herein facilitate stable operation of the gas turbine combustor. By actively tuning the anti-resonant frequency of the damper tubes to match the combustor resonant frequency, the performance of the damper tubes can be improved over the current design, and the number of tubes and the number of different lengths of tubes could potentially be reduced.

Exemplary embodiments of an combustor anti-resonant frequency system are described above in detail. The systems are not limited to the specific embodiments described herein, but rather, components of each assembly may be utilized independently and separately from other components described herein. Each combustor anti-resonant frequency component can also be used in combination with other combustor anti-resonant frequency components.

While the invention has been described in terms of various specific embodiments, those skilled in the art will recognize that the invention can be practiced with modification within the spirit and scope of the claims.

What is claimed is:

1. A method for operating a gas turbine engine including a combustor that includes a premixer assembly and a plurality of damper tubes, said method comprising:

determining the combustor resonant frequency;

coupling an anti-resonant frequency system to a combustor including a premixer assembly and a plurality of damper tubes, wherein the anti-resonant frequency system includes a substantially hollow bleed manifold; and adjusting the anti-resonant frequency system until the anti-resonant frequency of the damper tubes is approximately equal to the combustor resonant frequency.

2. A method in accordance with claim 1 wherein coupling an anti-resonant frequency system to the combustor comprises coupling an anti-resonant frequency system further including a plurality of substantially hollow extension tubes and a bleed valve, to the plurality of damper tubes.

3. A method in accordance with claim 2 wherein adjusting the anti-resonant frequency system comprises:

inputting a first quantity of combustor air though the damper tubes and into the manifold; and adjusting the bleed valve to release a second quantity of air from the manifold until the anti-resonant frequency of the damper tubes is approximately equal to the combustor resonant frequency.

4. A method in accordance with claim 1 wherein coupling an anti-resonant frequency system to the combustor comprises electrically coupling the anti-resonant frequency system including a power source, a cable electrically coupled to the power source, and a plurality of heating elements electrically coupled to the cable to the combustor.

5. A method in accordance with claim 4 wherein adjusting the anti-resonant frequency system comprises:

coupling at least one heating element to each damper tube; and adjusting the power source until the anti-resonant frequency of the damper tubes is approximately equal to the combustor resonant frequency.

6. A method in accordance with claim 5 wherein coupling at least one heating element to each damper tube comprises wrapping at least one heating element around an external surface of each damper tube.

7. A method in accordance with claim 5 wherein coupling at least one heating element to each damper tube comprises inserting at least one heating element at least partially into each damper tube.

8. A method in accordance with claim 1 wherein coupling an anti-resonant frequency system to a combustor comprises coupling an anti-resonant frequency system including a plurality of damper tubes to the combustor, the damper tubes fabricated in accordance with:

$f=c/4*L$;

where:

$c=\sqrt{\gamma RT}$ is an acoustic velocity of the air;

f is an effective frequency of damper tube;

L is an effective length of damper tube;

γ is a ratio of specific heats of the air;

R is the gas constant of air; and

T is an air temperature.

9. A combustor system for a gas turbine engine, said combustor system comprising:

a premixer assembly;

a plurality of damper tubes; and an anti-resonant frequency system coupled to said plurality of damper tubes, said anti-resonant frequency system configured to adjust the anti-resonant frequency of said damper tubes until the anti-resonant frequency of said damper tubes is approximately equal to a resonant frequency of the combustor, said anti-resonant frequency system comprising a substantially hollow bleed manifold configured to receive a first quantity of air from said combustor.

10. A combustor system in accordance with claim 9 wherein said anti-resonant frequency system further comprises:

a plurality of substantially hollow extension tubes coupled to said bleed manifold; and a bleed valve coupled to said bleed manifold, said bleed valve configured to release a second quantity of air from said manifold to facilitate changing an anti-resonant frequency of said damper tubes to be approximately equal to a resonant frequency of the combustor.

11. A combustor system in accordance with claim 9 wherein said anti-resonant frequency system comprises:

a power source;

a cable electrically coupled to said power source; and a plurality of heating elements electrically coupled to said cable, said power source configured to adjust an electrical current to said heating elements until the anti-resonant frequency of said damper tubes is approximately equal to a resonant frequency of the combustor.

12. A combustor system in accordance with claim 11 further comprising at least one heating element extending around an external surface of each said damper tube.

13. A combustor system in accordance with claim 11 further comprising at least one heating element inserted at least partially into each said damper tube.

14. A combustor system in accordance with claim 9 wherein said plurality of dampers are fabricated in accordance with:

$f=c/4*L$;

where:

$c=\sqrt{\gamma RT}$ is the acoustic velocity of the air;

f is an effective frequency of damper tube;

L is an effective length of damper tube;

γ is a ratio of specific heats of the air;

R is a gas constant of air; and

T is an air temperature.

15. A gas turbine engine comprising:

a compressor;

a turbine coupled in flow communication with said compressor; and a combustor system coupled between said compressor and said turbine, said combustor system comprising:

a premixer assembly;

a plurality of damper tubes; and an anti-resonant frequency system coupled to said plurality of damper tubes, said anti-resonant frequency system configured to adjust the anti-resonant frequency of said damper tubes until the anti-resonant frequency of said damper tubes is approximately equal to a resonant frequency of the combustor, said anti-resonant frequency system comprising a substantially hollow bleed manifold configured to receive a first quantity of air from said combustor.

16. A gas turbine engine in accordance with claim 15 wherein said anti-resonant frequency system further comprises:

a plurality of substantially hollow extension tubes coupled to said bleed manifold; and a bleed valve coupled to said bleed manifold, said bleed valve configured to release a second quantity of air from said manifold to facilitate changing an anti-resonant frequency of said damper tubes to be approximately equal to a resonant frequency of the combustor.

17. A gas turbine engine in accordance with claim 15 wherein said anti-resonant frequency system comprises:

a power source;

a cable electrically coupled to said power source; and a plurality of heating elements electrically coupled to said cable, said power source configured to change an electrical current to said heating elements until the anti-resonant frequency of said damper tubes is approximately equal to a resonant frequency of the combustor.

18. A gas turbine engine in accordance with claim 17 further comprising at least one heating element extending wound an external surface of each said damper tube.

19. A gas turbine engine in accordance with claim 17 further comprising at least one heating element inserted at least partially into each said damper tube.

20. A gas turbine engine in accordance with claim 15 wherein said plurality of dampers we fabricated in accordance with:

$f=c/4*L$;

where:

$c=\sqrt{\gamma RT}$ is the acoustic velocity of the air;

f is an effective frequency of damper tube;

L is an effective length of damper tube;

γ is a ratio of specific heats of the air;

R is a gas constant of air; and

T is an air temperature.

* * * * *

UNITED STATES PATENT AND TRADEMARK OFFICE

CERTIFICATE OF CORRECTION

PATENT NO. : 7,272,931 B2
APPLICATION NO. : 10/663008
DATED : September 25, 2007
INVENTOR(S) : Held et al.

It is certified that error appears in the above-identified patent and that said Letters Patent is hereby corrected as shown below:

In Claim 3, column 4, line 48, delete "though" and insert therefor -- through --.
In Claim 18, column 6, line 47, delete "wound" and insert therefor -- around --.

Signed and Sealed this

First Day of April, 2008

JON W. DUDAS
*Director of the United States Patent and Trademark Office*